US011723509B2

(12) United States Patent
Wang et al.

(10) Patent No.: US 11,723,509 B2
(45) Date of Patent: Aug. 15, 2023

(54) DEVICE FOR DISPENSING CLEANING AGENTS

(71) Applicant: SANHUA AWECO Appliance Systems GmbH, Neukirch (DE)

(72) Inventors: Zuo Wang, Immenstaad (DE); Erwin Wunn, Neukirch (DE); Ulrich Boettger, Kressbronn (DE); August Lanz, Tettnang (DE)

(73) Assignee: SANHUA AWECO Appliance Systems GmbH, Neukirch (DE)

( * ) Notice: Subject to any disclaimer, the term of this patent is extended or adjusted under 35 U.S.C. 154(b) by 246 days.

(21) Appl. No.: 16/474,035

(22) PCT Filed: Dec. 19, 2017

(86) PCT No.: PCT/EP2017/083416
§ 371 (c)(1),
(2) Date: Jun. 26, 2019

(87) PCT Pub. No.: WO2018/122026
PCT Pub. Date: Jul. 5, 2018

(65) Prior Publication Data

US 2019/0335975 A1 Nov. 7, 2019

(30) Foreign Application Priority Data

Dec. 29, 2016 (DE) ..... 10 2016 125 843.1

(51) Int. Cl.
*A47L 15/44* (2006.01)

(52) U.S. Cl.
CPC ..... *A47L 15/4409* (2013.01)

(58) Field of Classification Search
CPC ... A47L 15/4409; A47L 15/44; A47L 15/4463
See application file for complete search history.

(56) References Cited

U.S. PATENT DOCUMENTS 3,584,763 A * 6/1971 Donselman ..... A47L 15/4409 222/54
4,984,596 A * 1/1991 Westfelt ..... A47L 15/4409 134/58 DL
8,261,581 B2 * 9/2012 Cerruti ..... A47L 15/4418 68/17 R (Continued)

FOREIGN PATENT DOCUMENTS

CA 1088849 A 11/1980
CN 101474054 A 7/2009

(Continued)

*Primary Examiner* — Joseph L. Perrin
*Assistant Examiner* — Irina Graf
(74) *Attorney, Agent, or Firm* — Breneman & Georges

(57) ABSTRACT

The disclosure relates to a device for dispensing a cleaning agent into a dishwasher, having a cover element for closing and releasing at least one opening of a store for storing the cleaning agent and/or an operating agent, at least one actuating element being provided which has an actuation path (W) for opening and/or fixing the cover element so that an accidental opening or unlocking is effectively prevented. According to the disclosure this is achieved in that the actuation path (W) is oriented away from the store and transversely to the opening.

13 Claims, 5 Drawing Sheets

(56) References Cited

U.S. PATENT DOCUMENTS

Figure 1:
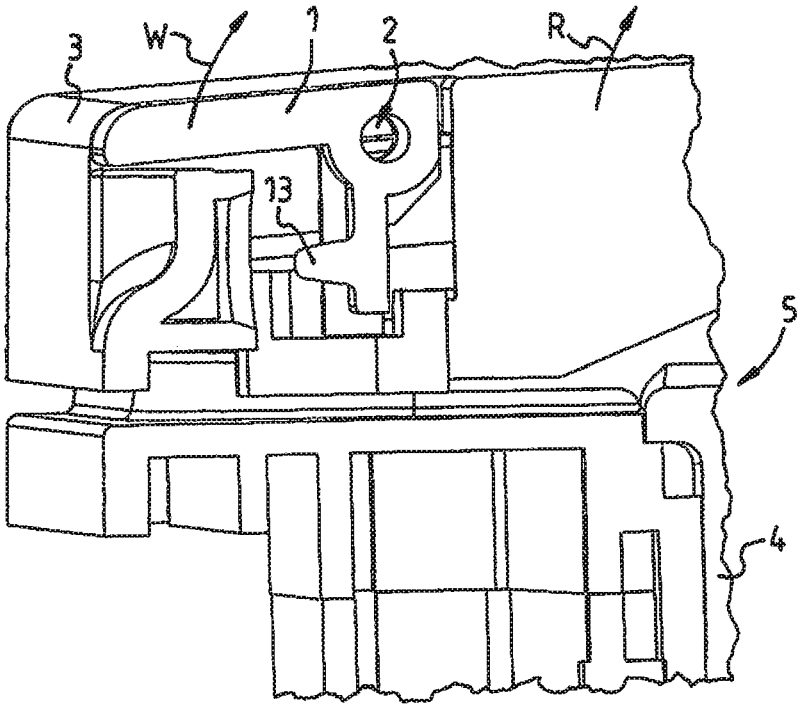

| | | | | |
|---|---|---|---|---|
| 2005/0103365 | A1* | 5/2005 | Cerruti | A47L 15/4409 134/93 |
| 2010/0000022 | A1* | 1/2010 | Hendrickson | D06F 39/022 8/137 |
| 2010/0000586 | A1* | 1/2010 | Hendrickson | A47L 15/4463 68/12.18 |
| 2011/0030729 | A1* | 2/2011 | Gnadinger | A47L 15/4409 68/17 R |
| 2016/0192820 | A1* | 7/2016 | Gadini | D06F 39/02 222/544 |
| 2016/0338565 | A1* | 11/2016 | Alexander | D06F 39/02 |
| 2017/0183806 | A1* | 6/2017 | Bixby | D06F 34/28 |
| 2020/0178756 | A1* | 6/2020 | Boyer | D06F 39/02 |

FOREIGN PATENT DOCUMENTS

| | | | |
|---|---|---|---|
| DE | 195 45 773 | A1 | 6/1996 |
| DE | 102 44 678 | A1 | 4/2004 |
| DE | 10 2005 013 748 | A1 | 9/2006 |
| EP | 0 780 087 | A2 | 12/1996 |
| WO | WO 2011/063942 | A1 | 6/2011 |
| WO | WO 2018/122026 | A1 | 7/2018 |

* cited by examiner

DEVICE FOR DISPENSING CLEANING AGENTS

The invention relates to a device for dispensing detergent into a dishwasher, comprising a cover element for closing and releasing at least one opening of a storage unit for storing the detergent and/or an operating agent, in accordance with the preamble of claim 1.

PRIOR ART

In dishwashers, dosing devices with covers have already been disclosed, in which the covers close or release receptacles for detergents or tablets or for final-rinse liquid.

In some dosing devices, an intermediate chamber or dosing chamber is arranged downstream from a storage chamber for rinse aid. A double-valve plunger actuates the valve function in the opening between storage chamber and dosing chamber, and in the outflow opening of the dosing chamber into the washing compartment of the dishwasher, in an oppositely acting manner. This means that, upon a single energization of the electromagnetic valve provided for the actuation, the opening between storage chamber and dosing chamber is opened and the outflow opening of the dosing chamber is closed.

In the transition to the currentless state, the dosing chamber is then closed off from the storage chamber and the outflow opening is opened, such that the final-rinse agent flows off into the washing compartment. This arrangement of the two chambers serves to predefine, with the aid of the predefined volume of the dosing chamber, a fixed dosing volume, wherein, upon each energization of the electromagnetic coil, rinse aid too is fed into the washing compartment of the dishwasher.

Dosing devices of this type are usually combined with a chamber for receiving detergent. For the addition of the detergent into the washing process, this chamber is opened with the aid of a flap, which is locked in the closed position and is opened by spring pressure after unlocking. For cost-saving reasons, the unlocking takes place with the same electromagnetic coil with which the dosing of the rinse aid is conducted.

In order to observe the program sequence of the washing process also in terms of the addition of the appropriate detergent or rinsing agent, it is here necessary that, upon the first energization of the coil, only the flap of the detergent chamber is actuated, and only upon a following energization of the coil is the rinse aid dosing actuated. To this end, in commercially available dishwashers, a lever arrangement with a ratchet device is used, which effects a latching of the actuation lever for the rinse aid upon the first energization and a valve actuation for the rinsing agent only from the point of the second energization. By opening of the dishwasher door, the ratchet mechanism is returned by means of gravity to the initial state, such that a wash program can run afresh from the beginning.

In addition, dosing devices for dishwashers are already known which, instead of a flap as the closing cover, have a sliding cover which executes a linear movement relative to a plane parallel of the boundary wall of the liquid detergent container, yet at the end of the closing operation performs a lowering in order to seal the cover (cf. EP 0 780 087 B1). Compared to a dosing device with a flap, these dosing devices avoid narrowing of the storage space in the dishwasher due to the movement space of the flap that has to be kept free.

However, a disadvantage of the last-named devices is that they entail a comparatively complex and fault-prone, in particular jamming or catching, guidance of the sliding cover, and a relatively large dosing device.

Furthermore, a dosing device is also known which comprises a pivotable turning cover (cf. DE 102 44 678) which pivots about a rotation axis roughly parallel to the housing or to the door, wherein once again a lowering is provided at the end of the closing process in order to seal the storage unit. However, it has been shown in practice that, in long-term use for example, the turning cover is relatively easily impaired or damaged during operation. Also, compared to the abovementioned sliding cover, the twisting movement for actuation of the turning cover is perceived by users to be ergonomically and esthetically less pleasing.

However, a disadvantage of these devices is that the button or the actuation element for the cover is in practice accidentally pressed, and the cover element thus opens the storage unit.

OBJECT AND ADVANTAGES OF THE INVENTION

By contrast, the object of the invention is to propose a device for dispensing detergents into a dishwasher comprising a cover element, wherein accidental opening or unlocking is effectively prevented.

Proceeding from a device of the type mentioned in the introduction, this object is achieved by the features of claim 1. Advantageous embodiments and developments of the invention are possible by the measures set out in the dependent claims.

Accordingly, a device according to the invention is characterized in that the actuation path is oriented away from the storage unit and in a direction transverse to the opening.

By means of such actuating or pulling of the actuation element by the user, a situation is effectively prevented in which accidental pressing, as in the prior art, causes the cover element to open or unlock. For example, in the prior art, the cover element can be inadvertently opened or unlocked by dishes or cutlery falling onto the actuation element.

By contrast, according to the present invention, it is possible to effectively prevent a situation where falling items such as cutlery or dishes cause the storage unit or the cover element to open. This effectively prevents inadvertent escape or outward flow of the operating agent or detergent and/or contamination thereof. Accordingly, the operating safety and user comfort are considerably improved according to the invention.

Preferably, at least one spring element is provided to define a fixing position of the actuation element. A fixing element, in particular a helical spring or an elastomer element, e.g. a rubber element or the like, can be arranged on the actuation element in an economically favorable and also structurally advantageous manner, such that an advantageous closing force or pressing force is generated for fixing the actuation element in the fixing position or locking position of the cover element.

Advantageously, an actuation device comprises at least the actuation element and a fixing element for fixing the cover. Thus, the actuation device can be designed in one part or in at least two parts. This means that the actuation element and the fixing element are designed as separate or separately adjustable and/or rotatable/pivotable elements, or that they are connected integrally to each other to form one structural unit.

Preferably, the actuation device has at least one pivot axis for pivoting the fixing element with respect to the actuation element. Thus, a relative movement or adjustment of the fixing element with respect to the actuation element can be realized. A joint, in particular a hinge, is preferably provided with the pivot/rotation axis. If appropriate, the pivot axis is formed as a separate shaft or shaft element. Thus, a flap hinge can advantageously be formed. Alternatively, a film hinge can also be realized, in particular made of plastic, such that the fixing element is pivotable with respect to the actuation element about or with the film hinge or the actuation element. It is advantageous and particularly cost-effective here if the actuation device is produced as an integral structural unit made of plastic, in particular injection-molded plastic, wherein the film hinge is arranged between the fixing element and the actuation element, in particular as a thinning or a region with a relatively small wall thickness.

Advantageously, the actuation element and/or the actuation device is pivotable about a pivot axis and/or a rotation axis. It has been shown that it is in this way possible to realize a structurally advantageous implementation of an actuation path away from the storage unit and in a direction transverse to the opening. Thus, the pivot axis and/or the rotation axis are preferably oriented substantially parallel to the opening or to the cover element.

In an advantageous embodiment of the invention, the actuation element and/or the actuation device is designed as a rocker that is pivotable or rotatable about the pivot axis and/or rotation axis. A rocker can be manually actuated without great effort by the user or the operator, wherein the locking of the cover element is unlocked.

Advantageously, the actuation element and/or the actuation device has at least one detent lug for locking/fixing the fixing element or is designed as a detent element. It is thus advantageously possible to realize a locking of the actuation element and thus a locking of the cover element. A latching action is on the one hand advantageous when closing the cover, and at the same time a latching action can advantageously be unlocked or released by the manual pulling or actuating of the actuation element according to the invention with an actuation path directed away from the storage unit.

For example, a housing element of the device comprises the actuation element. Advantageously, the cover element and/or the actuation device comprises the actuation element. It has been shown that it is in this way possible to realize an advantageous implementation of the actuation path according to the invention away from the storage unit. At the same time, the cover element can be manually opened and lifted advantageously in the direction of the actuation path.

Preferably, an unlocking of the actuation element is achieved with the aid of an adjustment mechanism, wherein an advantageous pivot axis is provided about which an unlocking or locking element is mounted pivotably and can be adjusted, for example, with the aid of an actuator, in particular an electromagnetic coil or the like.

In a particular development of the invention, the actuation element is provided for locking the cover element of the storage unit for the detergent, in particular for detergent powder and/or detergent tablets or the like. For example, in an operating phase of the dishwasher, it is thus possible to realize automated unlocking with the aid of the unlocking element or the like and with the aid of the actuator or the coil.

Alternatively or additionally, the actuation element can be manually actuated/unlocked according to the invention, for example with the door open. This means that automated unlocking takes place, for example, with the aid of a pivotable unlocking element and, if necessary for example, the actuation element can be actuated manually by the user along the actuation path according to the invention.

Advantageously, the storage unit is designed as a liquid storage unit for storing an operating liquid, in particular a final-rinse liquid. The actuation element according to the invention can also be used, for example, for storing detergent and/or for storing final-rinse liquid. Precisely by the use on the one hand for the detergent storage unit, i.e. for detergent powder, detergent tablets or the like, and on the other hand for the final-rinse storage unit or the liquid storage unit, it is possible to use in each case a similar actuation element or in each case an identical actuation element for the respective cover elements of the respective storage unit. In this way, it is possible to achieve an esthetically pleasing and uniform design of the cover element and/or of the actuation element, which leads to a pleasing and esthetically advantageous effect on the user.

ILLUSTRATIVE EMBODIMENT

Figure 2:
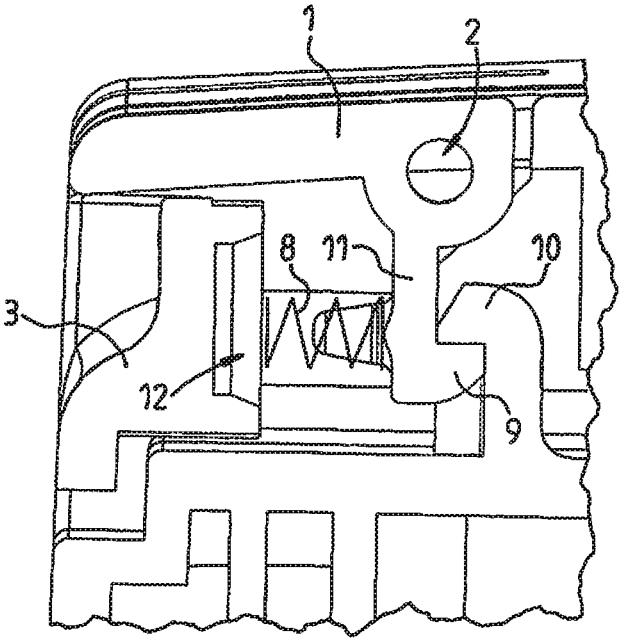
Figure 3:
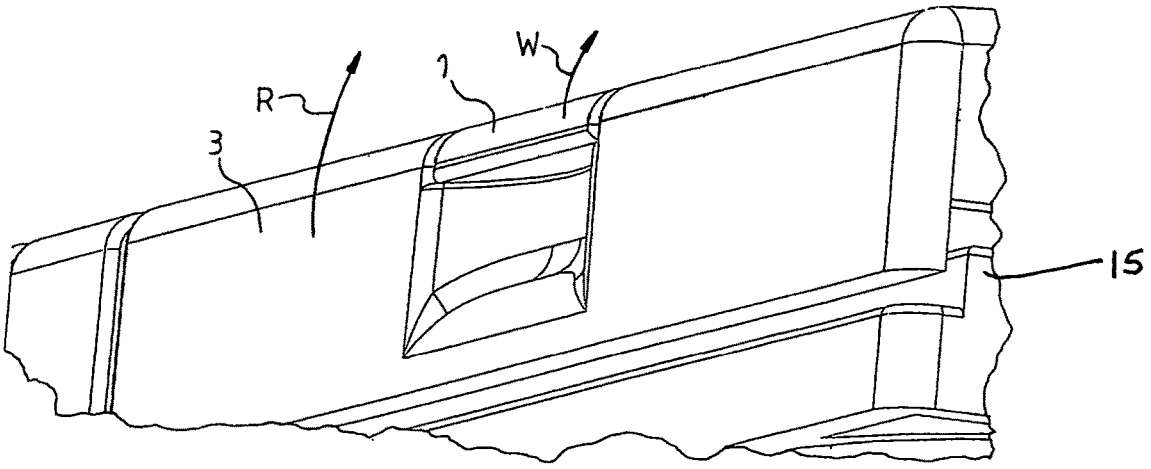
Figure 4:
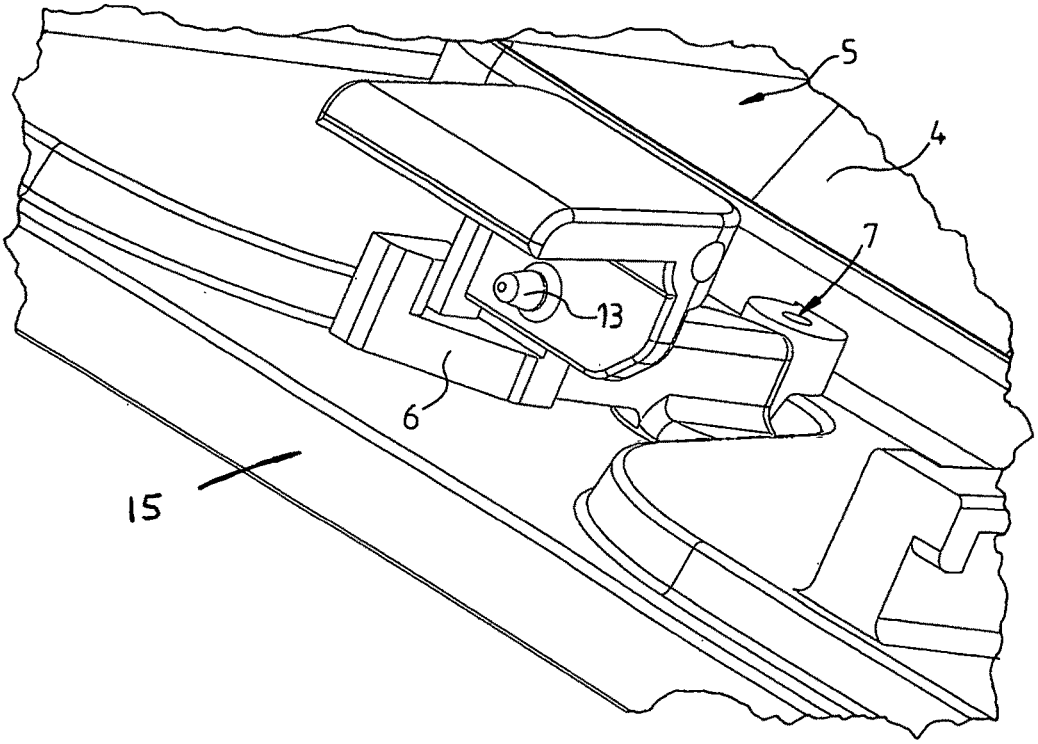
Figure 5:
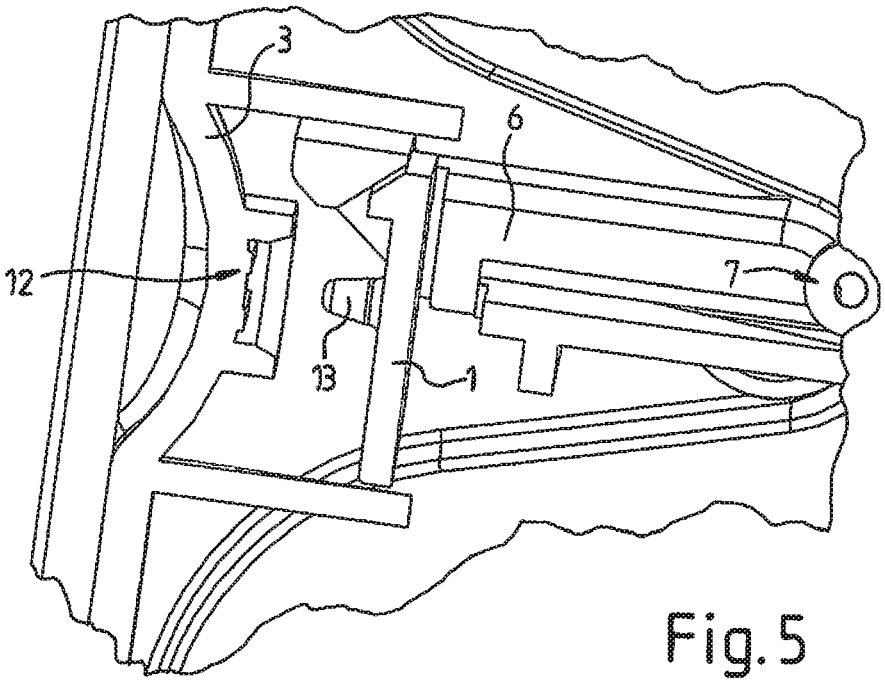
Figure 6:
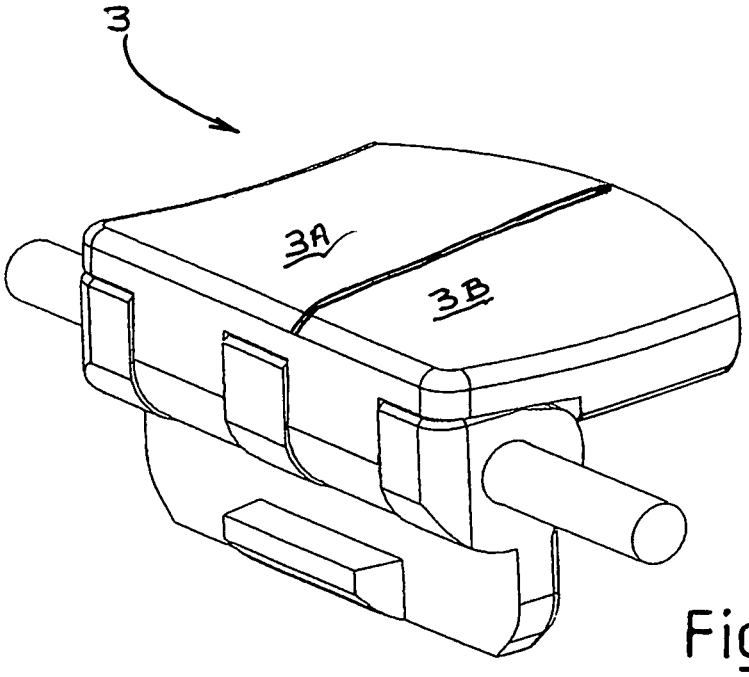
Figure 7:
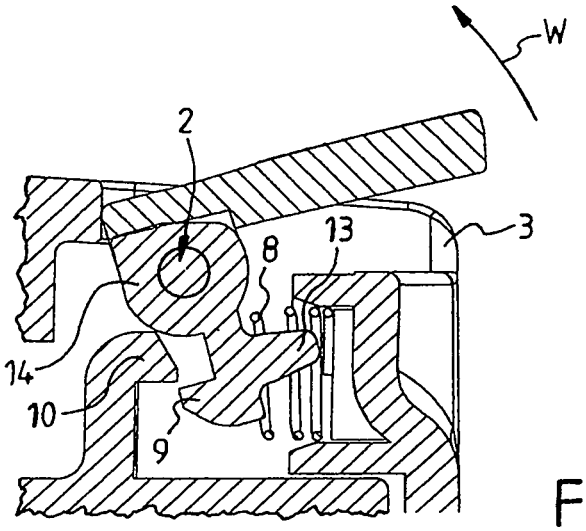
Figure 8:
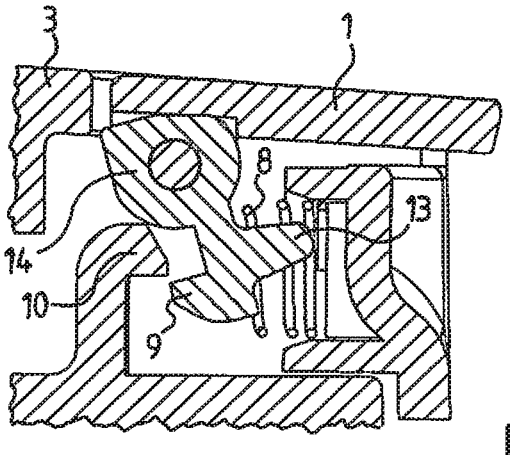
Figure 9:
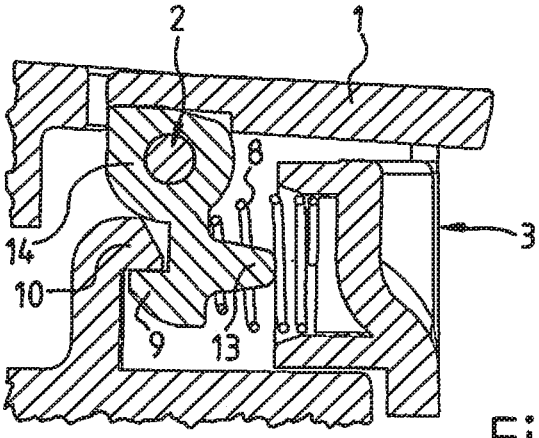

An illustrative embodiment of the invention is depicted in the drawing and is explained in greater detail below with reference to the figures, in which:

FIG. 1 shows a schematic lateral section through a first device with a first actuation element according to the invention, FIG. 2 shows a schematic second section parallel to the section according to FIG. 1, FIG. 3 shows a schematic perspective view of the first device according to the invention, with a closed cover element with the first actuation element according to the invention, FIG. 4 shows a schematic perspective detail of the device according to the invention with the first actuation element and with the cover element released, FIG. 5 shows a schematic perspective section of the first device according to the invention in a plan view, FIG. 6 shows a schematic perspective detail of a second device according to the invention with a multi-part actuation device having a second actuation element, FIG. 7 shows a schematic section of the second device according to FIG. 6 upon opening/actuating the second actuation element according to the invention, FIG. 8 shows a schematic section of the second device according to FIG. 6 during the process of closing the cover element according to the invention, and FIG. 9 shows a schematic section of the second device according to FIG. 6, with the cover element according to the invention closed and locked.

A first device for dispensing detergent into a dishwasher is shown schematically in section in FIG. 1. Here, an actuation element 1 or a rocker 1 is mounted or fixed on a cover element 3 so as to be rotatable about a rotation axis 2. To manually actuate or open the cover element 3 in direction R, the rocker 1 is moved about the rotation axis 2 in direction W, within the meaning of the invention away from a storage unit 4 or an opening 5 of the storage unit 4.

The opening 5 of the storage unit 4 is depicted especially in the perspective view according to FIG. 4. It will be seen from this that the opening 5, or a free cross section of the storage unit 4, is oriented substantially parallel to the plan view of the device. In devices for dispensing detergent into a dishwasher, a corresponding storage unit 4 is customarily used for the detergent powder or for a detergent tablet or the like and, for example, also as a liquid storage unit 4 for final-rinse liquid.

During the cleaning operation, detergent storage units 4 of this kind are released by means of an unlocking element 6 or bolt 6, wherein the bolt 6 is pivotable about a pivot axis 7. The pivoting of the bolt 6 about the pivot axis 7 is effected by means of an actuator, preferably by means of an electromagnetic coil, which is not described in detail. However, this non-manual unlocking or actuating by means of a coil is generally known to a person skilled in the art. As an alternative or addition to this automated unlocking of the rocker 1 by means of the bolt 6 or a corresponding coil, a manual unlocking or actuating of the rocker 1 according to the invention can also take place in the direction W about the pivot axis 2.

In FIG. 2, the rocker 1 is shown parallel to the section according to FIG. 1, such that a compression spring 8 is advantageously depicted which positions the rocker 1 in the fixing or locking position shown in FIGS. 1 and 2. For this purpose, the rocker 1 has a detent lug 9, which is operatively connected to a second detent lug 10 of a housing of the device according to the invention.

During the closure of the cover 3 counter to the direction R, the detent lug 9 locks with the detent lug 10, such that the cover and the rocker 1 are firmly fixed advantageously in the depicted position or locking position. For this purpose, the spring 8 exerts a pressing force on an arm 11 of the rocker 1, such that the detent lugs 9 and 10 are held firmly to each other in a fixed position.

To generate the pressing force of the spring 8, the cover 3, for example, has a counter-holder 12. Moreover, the rocker 1 has a pin 13, which ensures centering of the spring 8 or positioning of the spring 8. With the aid of the rocker 1, which is to be pulled manually away from the storage unit 4, i.e. in direction W, it is ensured that accidental opening of the cover 3, e.g. by falling articles such as dishes or cutlery, etc., is prevented when the dishwasher door is opened. Accordingly, the operating safety is improved, and it is possible to effectively prevent operating agent/detergent from flowing or falling out of the storage unit 4 when closing the dishwasher door and/or to avoid soiling of the contents of the storage unit 4.

The rocker 1 can be used not just for the detergent storage unit 4, i.e. for detergent powder or a detergent tablet, but alternatively also for a cover (not shown in detail) of a storage unit for final-rinse liquid, which cover is correspondingly to be activated likewise in the direction W. Thus, two identical rockers 1 can be provided in the detergent storage frame 15 (FIG. 3, 4) and used both for the detergent storage unit and also for the final-rinse storage unit by dividing cover 3 into separate covers 3A as a detergent storage unit and 3B as a final rinse storage unit as illustrated in FIG. 6, which on the one hand means a reduction in the number of parts, and thus cost savings, and on the other hand permits an effect that is esthetically pleasing for the user.

A second device according to the invention is shown schematically in FIGS. 6 to 9. In contrast to the first variant according to FIGS. 1 to 5, it does not comprise a one-part actuation element 1 or actuation device according to the invention, but instead a three-part actuation device with a separate actuation element 1, a separate fixing element 14 and a separate rotation axis 2. These form a joint/flap hinge, such that the fixing element 14 is advantageously entrained in the opening or actuating of the actuation element 1 in the direction W according to the invention (cf. FIG. 7). During closure of the cover 3, the fixing element 14 is able to adjust or pivot/rotate relative to the actuation element 1 (cf. FIG. 8) and, with the detent lug 9, latches onto the detent lug 10 of the housing, such that the cover 3 is closed and fixed.

LIST OF REFERENCE SIGNS

1 rocker
2 rotation axis
3 cover
3A detergent storage unit
3B final rinse storage unit
4 storage unit
5 opening
6 bolt
7 pivot axis
8 spring
9 lug
10 lug
11 arm
12 counter-holder
13 pin
14 fixing element
15 detergent storage frame
R direction
W direction

What is claimed is:

1. In a device for dispensing detergent in a dishwasher having a detergent storage compartment and a cover element for closing the detergent storage compartment disposed vertically on a pivotal door of the dishwasher, wherein the improvement comprises a detergent storage frame having a pivotal actuation device comprising a pivotable rocker having a first end, a second end, and a pivot; wherein said pivot is common to the cover element and the pivotable rocker to open, close and lock the cover element; said second end of the pivotable rocker terminating in a first locking lug having a first flat or tapered slidable locking surface; a second locking lug disposed on the detergent storage frame having a corresponding flat or tapered mating locking surface to mate with the first flat or tapered slidable locking surface; and wherein the cover element is disposed on or adjacent to the first end of the pivotable rocker that has an actuation path oriented away from an opening in the detergent storage compartment and transverse to the an opening; and wherein the first or second locking lug is not on or does not extend through the cover element, and the pivotable rocker is pivotable around the pivot, wherein the first end of the pivotable rocker is rotatable with respect to the second end of the pivotable rocker around the pivot, and the cover element is separately moveable with respect to said pivot.

2. The device as claimed in claim 1 further comprising an arming pin counter holder disposed on the pivotable rocker, an arming pin disposed on the detergent storage frame, and at least one spring element disposed between the arming pin and the arming pin counter holder to define a fixing position of the at least one pivotable rocker.

3. The device as claimed in claim 1 wherein the pivotable rocker has a pivot shaft pivoted on the detergent storage frame for pivoting the pivotable rocker.

4. The device as claimed in claim 1 wherein the pivotable rocker has at least one detent in the first locking lug for locking/fixing the pivotable rocker.

5. The device as claimed in claim 1 wherein the pivot of the pivotable rocker is oriented substantially parallel to the cover element.

6. The device as claimed in claim 1 wherein the detergent storage compartment has a liquid storage unit for storing an operating liquid.

7. The device as claimed in claim 6 wherein the detergent storage frame has a final rinse storage unit.

8. The device as claimed in claim 7 further comprising a second pivotable rocker to close the final rinse storage unit.

9. The device as claimed in claim 1 wherein the device is disposed in the dishwasher.

10. The device as claimed in claim 1 further comprising an unlocking element activated by an electromagnetic coil.

11. The device as claimed in claim 10 wherein the pivotable rocker comprises an arming pin counter holder and a spring.

12. The device claimed in claim 1 wherein the first end of the pivotable rocker terminates at the cover element forming a smooth outside surface when the device is in a closed position.

13. The device as claimed in claim 1 wherein the second end of the pivotable rocker has a cam shaped surface to slidably engage the first end of the pivotable rocker.

* * * * *